US005827098A

United States Patent [19]

Cunningham

[11] Patent Number: 5,827,098

[45] Date of Patent: Oct. 27, 1998

[54] COLD WEATHER LIFE SAVING DEVICE

[76] Inventor: Alan D. Cunningham, #8 Hordal Rd., Yellowknife, N.T., Canada, X1A-3E1

[21] Appl. No.: 858,724

[22] Filed: May 19, 1997

[51] Int. Cl.[6] ..... B63C 9/32

[52] U.S. Cl. ..... 441/82; 224/660

[58] Field of Search ..... 441/80, 82, 84, 441/88, 106, 108, 113, 136; 224/660

[56] References Cited

U.S. PATENT DOCUMENTS

| | | | |
|---|---|---|---|
| 2,368,558 | 1/1945 | Maloney | 441/108 |
| 5,209,685 | 5/1993 | Hammes | 441/82 |

FOREIGN PATENT DOCUMENTS

| | | | |
|---|---|---|---|
| 2573382 | 5/1986 | France | 441/108 |

OTHER PUBLICATIONS

North Water DFO Swiftwater Rescue Belt, The REscue Source, p. 29.

*Primary Examiner*—Jesus D. Sotelo
*Attorney, Agent, or Firm*—David S. Thompson

[57] ABSTRACT

A cold weather life saving device, useful in surviving a fall through ice into water, provides an elongate belt, sized to be worn about the waist of an individual, typically over heavy clothing. The belt provides a tubular center portion that is typically two feet in length and approximately three inches in diameter. Flotation devices are carried at evenly spaced intervals within the center portion of the elongate belt. In a preferred embodiment, four closed-cell ethylene cubes having 2.5 inch sides are used. The four flotation devices define three storage pouches between them, which may be isolated by divider walls within the tubular center portion. These pouches are typically square in lengthwise cross-section and provide zippered openings which allow the secure storage of survival supplies. A plurality of utility rings are carried by the elongate belt, and provide support for attachment of a number of tools, including a telescoping pole or a sportsman's saw, or other bulky equipment. A telescoping pole is disclosed, providing four two-foot segments and associated locking mechanisms, thereby supporting an extended length of eight feet. The device may be sold as a kit of parts. In the preferred embodiment of the invention the storage pouches are used to carry essential equipment, typically including a 1.5 oz. "space" blanket, water-proof matches, water purification tablets, and a candle.

6 Claims, 2 Drawing Sheets

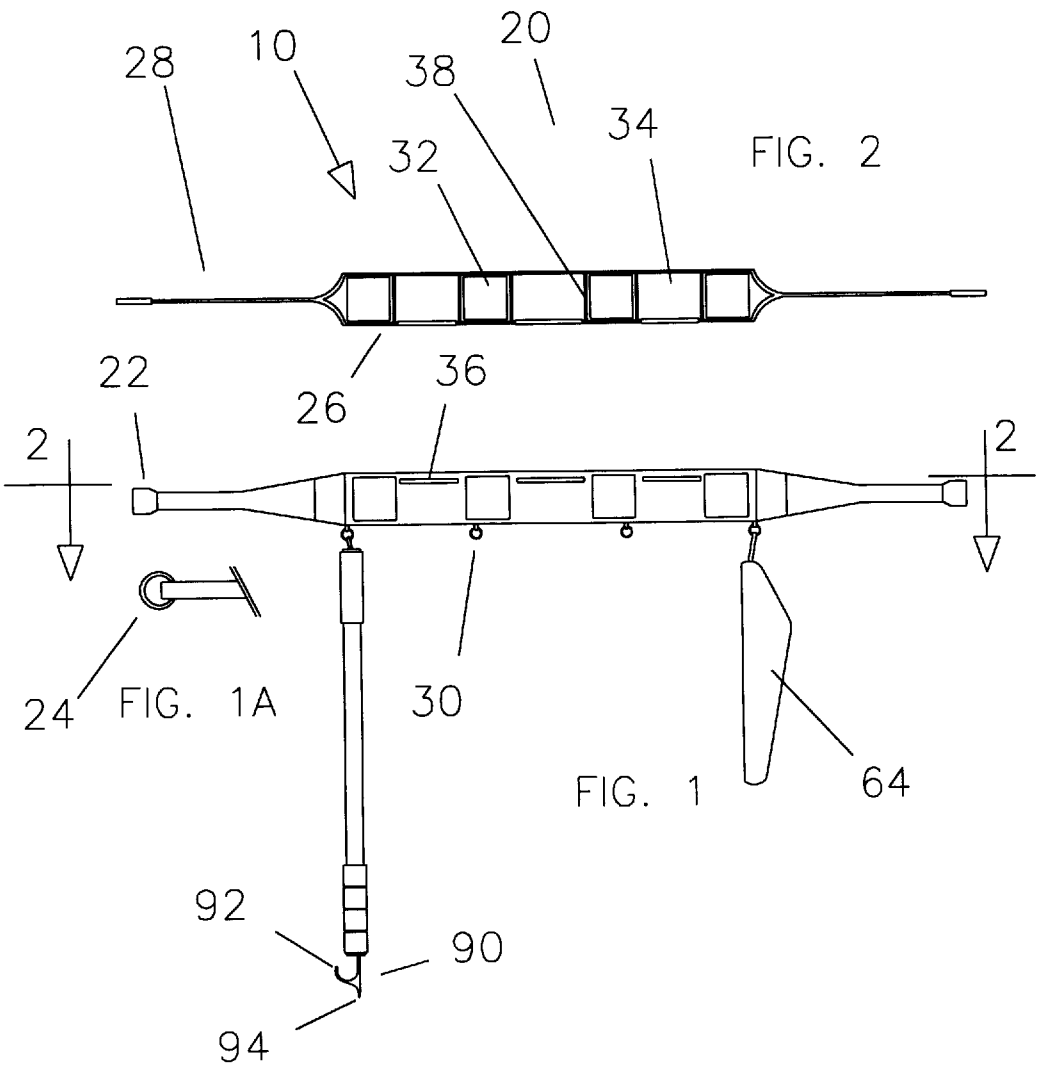
FIG. 2
FIG. 1
FIG. 1A
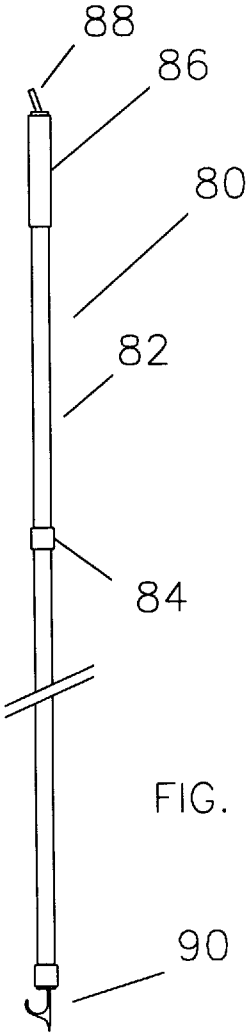
FIG. 3

COLD WEATHER LIFE SAVING DEVICE

CROSS-REFERENCES

There are no applications related to this application filed in this or any foreign country.

BACKGROUND

Increasing numbers of outdoorsmen are participating in hunting, fishing, hiking and camping during all four seasons. The winter months are increasingly popular with sportsmen, but involve dangers not seen during the warmer seasons, In particular, a surprising number of reasons result in people spending time on frozen lakes and other waterways. These include not only ice skating, ice fishing and snowmobiling, but also such activities commercial trucking in remote areas where ice builds an inexpensive bridge over which freight may be hauled. Not surprisingly, accidents are increasingly common, and as a result survival after falling through the ice layer is of increasing concern.

Certain items of equipment that would be desirable to have in the event of breaking through the ice are well-known and marketed. However these items are not marketed together, nor are they adequately contained in a supporting structure that is suitable for prolonged use by individuals whose employment or recreation results in extended periods of time spent on ice over water.

For the foregoing reasons, there is a need for a cold weather life saving device that combines a plurality of articles in a body that is easily worn for extended periods by those spending time on ice over bodies of water.

SUMMARY

The cold weather life saving device of the present invention provides some or all of the following structures.

(A) An elongate belt, having an overall length that is sufficiently adjustable to fit any person and over the outside of heavy parkas and snowmobile suits. The belt provides a tubular center portion that is typically two feet in length and approximately three inches in diameter.

(B) Flotation devices are carried at evenly spaced intervals within the tubular center portion of the elongate belt. In a preferred embodiment, four closed-cell ethylene cubes having 2.5 inch sides are used.

(C) The four flotation devices create three storage pouches between them, which may or may not be isolated by divider walls within the tubular center portion. These pouches are typically rectangular in cross-section and provide releasably fastenable openings which allow the secure storage of survival supplies.

(D) A plurality of utility rings are carried by the elongate belt, and provide support for attachment of a number of tools, including a telescoping pole or a sportsman's saw. Other bulky equipment, including a walkie-talkie, cellular telephone or a flashlight may also be carried by the utility rings.

(E) A telescoping pole is invaluable in rescuing someone who as fallen through the ice, or in saving one's self. In a preferred embodiment, the poll provides four two-foot segments and associated locking mechanisms, thereby supporting an extended length of eight feet. A grip at the upper end allows convenient manual operation, while a hook/pick combination at the lower end allows the pole to be used to attached to many objects.

(F) In the preferred embodiment of the invention, the storage pouches are used to carry essential equipment, typically including a 1.5 oz. "space" blanket, waterproof matches, water purification tablets, and a candle. Other items, such as a bundled light-weight cord, a pen-light or a pocket knife may also be included.

It is therefore a primary advantage of the present invention to provide a novel cold weather life saving device having an elongate belt body formed of nylon fabric having a tubular center portion that carries a plurality of cube-shaped flotation devices at spaced intervals, the flotation devices holding the nylon fabric in a manner that defines pouches having square or rectangular cross-section between the flotation devices, wherein the pouches are adapted for use in the storage of survival equipment.

Another advantage of the present invention is to provide a novel cold weather life saving device having a telescoping pole that is extendible from a storage length of approximately two feet to a functional length of approximately eight feet, and that provides a combined hook and pick end, as an aid in rescue and survival.

A still further advantage of the present invention is to provide a novel cold weather life saving device having a plurality of utility rings for use in carrying tools and equipment such as a sportsman's saw, the telescoping pole, a walkie-talkie and a flashlight, which may be invaluable in an emergency.

DRAWINGS

These and other features, aspects, and advantages of the present invention will become better understood with regard to the following description, appended claims, and accompanying drawings where:

FIG. 1 is an isometric view of a version of the cold weather life saving device of the invention, having a telescoping pole and a sportsman's saw attached;

FIG. 1A is an isometric view of an alternative fastener that may be used to attach the device of FIG. 1 to a user;

FIG. 2 is a cross-sectional view of the device of FIG. 1, taken along the 2—2 lines;

FIG. 3 is a side isometric view of the telescoping pole of FIG. 1, extended into its usable configuration.

DESCRIPTION

Figure 4:
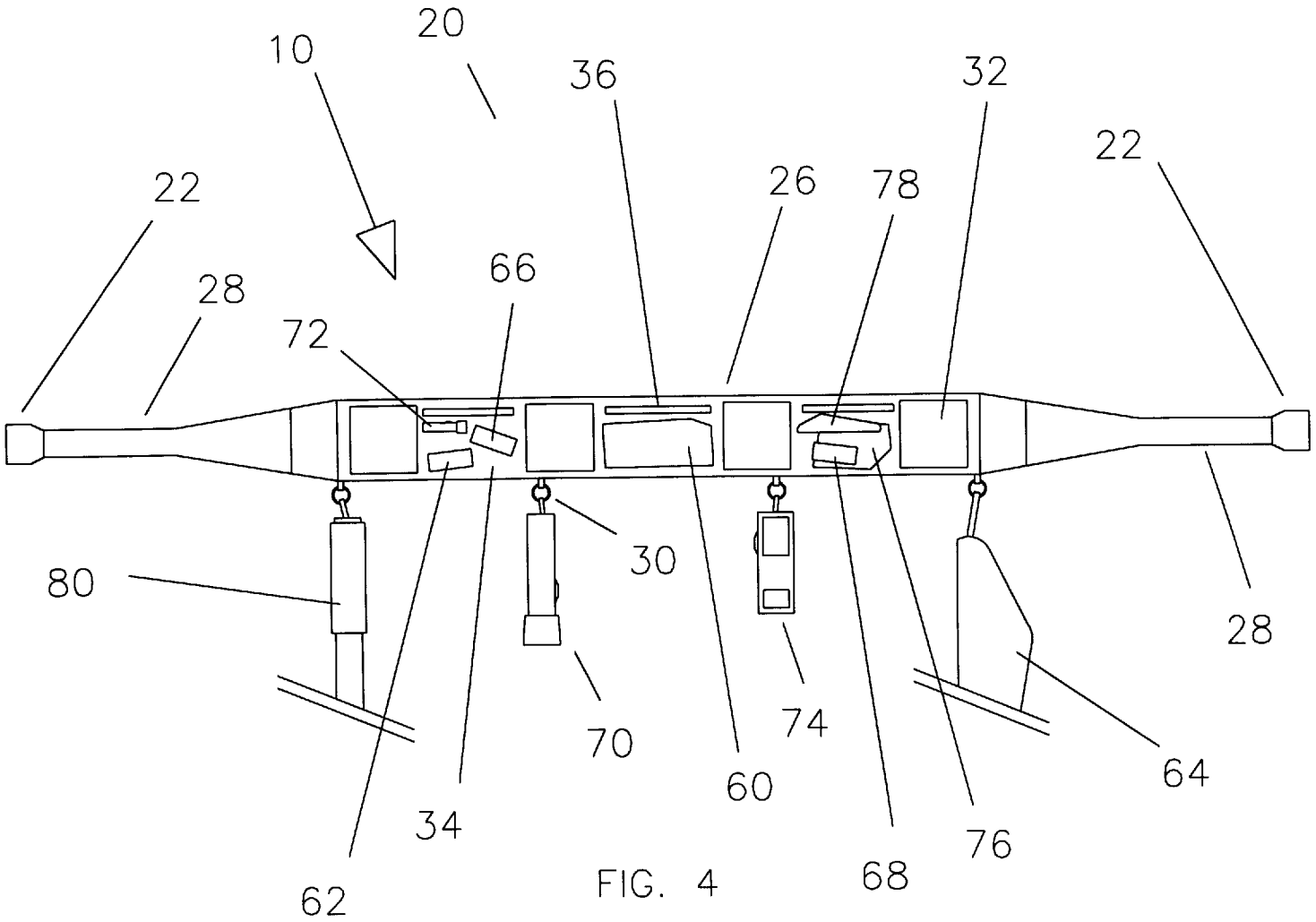
FIG. 4 is a slightly enlarged view of the tubular central portion of the elongate belt body, showing many items of the kit of parts included by the invention.

Referring in particular to FIG. 1, a cold weather life saving device 10 constructed in accordance with the principles of the invention is seen. An elongate belt body 20 is sized to be worn about the waist of an individual, typically over heavy clothing. Equipment suited for use in an emergency cold weather situation is carried by the belt, both within storage pouches 34 and by utility rings 30 supported by the belt. A kit of parts included in the preferred version of the cold weather life saving device 10 includes the belt body 20, as described below, a "space" blanket 60, matches 62, a sportsman's saw 64, water purification tablets 66, a long-burning candle 68, a flashlight 70 or a pen-light 72, a walkie-talkie or cellular telephone 74, a bundled cord or string 76 and a pocket knife 78.

The elongate belt body 20 is sized to be adjustable to fit all individuals, and typically has an overall length of approximately 48 inches. In a preferred embodiment, belt body is made of 100 denier nylon with a 1.5 oz. polyurethane waterproof coating. In the preferred embodiment, the belt is releasably fastened about the waist of an individual by means of an adjustable mating pair of plastic closures 22, as seen in FIG. 1. Alternatively, any suitable type of fastener, such as a dual ring closure 24, as seen in FIG. 1A, may be used. In either case, the belt is adjustable in length, and may be worn over or under heavy outer clothing.

The belt body provides a tubular center portion 26 and tapered end portions 28 which carry fasteners 22 or 24. The center portion 26 is typically 24 inches in length and 3 or more inches wide. Optionally, fabric divider walls 38 segment the interior cavity of the tubular center portion into a plurality of compartments. As seen in the cross-sectional view of FIG. 1, seven compartments are present in the preferred version; four compartments carrying flotation devices, and compartments forming storage pouches. Segmentation by the divider walls, when present, tends to force the flotation devices and storage compartments into a symmetrical arrangement. This prevents bunching of the flotation devices on one side of the tubular center portion 26.

Four flotation devices 32 are carried within the center portion of the belt, as seen in FIGS. 1 and 2. The flotation devices are typically chosen to be sufficient to cause the entire cold weather life saving device 10 to float if dropped in water. The slight positive buoyancy is not generally enough to float a person in the water, but may be an incremental aid in doing so.

In a preferred embodiment, the flotation devices are made of ETHAFOAM, a closed-cell ethylene product. The flotation devices are generally cube-shaped, having a 2.5 inch side. The cube shape of the flotation devices encourages the cavity within the tubular center portion 26 to have a square cross-section when taken in the direction perpendicular to the length of the belt body. This advantageously creates storage pouches 34 that do not tend to bulge excessively when filled, since the pouches are generally held in an "open" configuration, as seen in FIG. 2, even when empty.

In a preferred embodiment, three storage pouches 34 are separated by the flotation devices, and defined within the tubular center portion 26 of the belt body. The storage pouches may be separated by optional divider walls 38, although this is not required. A reclosable fastener, such as zipper 36, allows the storage pouches 34 to be opened or closed, as desired.

As seen in FIGS. 1 and 3, a telescoping pole 80, is carried by a utility ring 30 supported by means of a fastening clip 88. The telescoping pole has a shortened storage configuration, as seen in FIG. 1, having a length of approximately two feet, and an extended usable configuration, as seen in FIG. 3, having a length of approximately eight feet. The telescoping pole 80 is useful in reaching out to someone who has fallen through the ice and is in the water. It is also important for the person in the water to have such an elongate tool that can be used to reach out and hook onto some object, as a step in getting out of the water.

In the preferred embodiment, the telescoping pole 80 provides a chain of four interlocked segments 82 typically connected by threaded fastening mechanisms 84 that allow the user to secure the segments into either the "nested" or shortened storage configuration, or the extended configuration. When unlocked, the segments 82 are slidably related, each being incrementally larger or smaller than the adjacent segment.

An upper grip 86 is typically made of soft rubber, and allows the user to maintain a firm grip, even in wet conditions.

An end piece 90, carried by the lower end of the telescoping pole, is typically removable and replaceable, allowing the user to select from multiple end pieces. An end piece having a hook 92 and a pick 94 allows the user to either use the pole to push or pull. The pick may be particularly useful in icy conditions, since the pick may be inserted into the ice.

The cold weather life saving device 10 may also include a kit of parts, including the below survival supplies, which are selected for their ability to aid an individual who has fallen through the ice. A sportsman's saw 64, carried by a utility ring 30 or in one of the pouches 34 allows the user to prepare fuel for a fire, cut rope or fabric, as needed, in an emergency. A thermal or "space" blanket 60, made of aluminized, non-stretch polyester, stays flexible in freezing temperatures and reflects body heat back to the body and yet weighs only 1.5 oz. Such a blanket is carried by one of the pouches 34. Matches 62 and a long burning candle 68 help in the building of a fire of in the production of light. Water purification tablets help to provide a safe supply of drinking water, thereby preventing dehydration. Optionally, a flashlight 70 and a walkie-talkie or cellular telephone 74 may be carried on the utility rings. Similarly, the user may want to carry a pen light 72, a folded cord 76 or pocket knife 78.

To use the instant invention, the user simply fastens it about the waist, either under or over heavy outer garments. If the user or a companion unfortunately falls through the ice, the user will have available an extensive selection of items that will be of invaluable assistance returning the victim to firm ground, restoring normal body temperature and summoning medical or evacuation assistance.

The telescoping pole may be used in its extended configuration to reach out to a person, or to hook onto something. Using the pole in its collapsed configuration, an individual in the water may grasp the pole just over the end piece 90 and use the pick 94 in an effort to "claw" one's way back onto the surface of the ice. Also, where the ice is very thin, the extended pole may be used to "spread" weight over a broader area, in an effort to prevent the ice from fully breaking.

The previously described versions of the present invention have many advantages, including a primary advantage of providing a novel cold weather life saving device having an elongate belt body formed of nylon fabric having a tubular center portion that carries a plurality of cube-shaped flotation devices at spaced intervals, the flotation devices holding the nylon fabric in a manner that defines pouches having square or rectangular cross-section between the flotation devices, wherein the pouches are adapted for use in the storage of survival equipment.

Another advantage of the present invention is to provide a novel cold weather life saving device having a telescoping pole that is extendible from a storage length of approximately two feet to a functional length of approximately eight feet, and that provides a combined hook and pick end, as an aid in rescue and survival.

A still further advantage of the present invention is to provide a novel cold weather life saving device having a plurality of utility rings for use in carrying tools and equipment such as a sportsman's saw, the telescoping pole, a walkie-talkie and a flashlight, which may be invaluable in an emergency.

Although the present invention has been described in considerable detail and with reference to certain preferred versions, other versions are possible. For example, a variety of equipment could be substituted, where the similarity of the structure of the equipment substituted was such that the resulting life saving device achieved the same desired functionality. In the instant disclosure, the invention resides not in any one of these features per se, but rather in the particular combination of all of them herein disclosed and claimed and it is distinguished from the prior art in this particular combination of all of its structures for the functions specified.

What is claimed is:

1. A cold weather life saving device, comprising:

(A) an elongate belt body, having a tubular center portion;

(B) a plurality of flotation devices carried at evenly spaced intervals within the center portion of the elongate belt;

(C) at least one storage pouch, defined within the center portion in a space between two of the plurality of flotation devices, the at least one storage pouch having a releasably fastenable opening thereby allowing the secure storage of survival supplies;

(D) at least one utility ring, carried by the elongate belt; and (E) a telescoping pole, carried by one of the at least one utility ring, having a plurality of segments and associated locking means for transforming the telescoping pole between a shortened storage configuration and an extended usable configuration, and having an end piece carried by one of the plurality of segments.

2. The cold weather life saving device of claim 1, further comprising a thermal blanket, carried by one of the at least one storage pouches.

3. The cold weather life saving device of claim 2, further comprising water-proof matches and a candle, carried by one of the at least one storage pouches.

4. The cold weather life saving device of claim 1, further comprising water purification tablets, carried by one of the at least one storage pouches.

5. A cold weather life saving device, comprising:

(A) an elongate belt body, having a tubular center portion;

(B) a plurality of cube-shaped flotation devices carried at evenly spaced intervals within the center portion of the elongate belt;

(C) at least one storage pouch, defined within the center portion in a space between two of the plurality of flotation devices, the at least one storage pouch having a releasably fastenable opening thereby allowing the secure storage of survival supplies;

(D) at least one utility ring, carried by the elongate belt;

(E) a telescoping pole, carried by one of the at least one utility ring, having a plurality of segments and associated locking means for transforming the telescoping pole between a shortened storage configuration and an extended usable configuration, and having an end piece carried by one of the plurality of segments;

(F) a thermal blanket, carried by one of the at least one storage pouches;

(G) water-proof matches and a candle, carried by one of the at least one storage pouches; and (H) water purification tablets, carried by one of the at least one storage pouches.

6. A kit of parts for surviving a fall through a sheet of ice into water, comprising:

(A) a cold weather life saving device, comprising:

(a) an elongate belt body, having a tubular center portion;

(b) a plurality of flotation devices carried at evenly spaced intervals within the center portion of the elongate belt;

(c) at least one storage pouch, defined within the center portion in a space between two of the plurality of flotation devices, the at least one storage pouch having a releasably fastenable opening thereby allowing the secure storage of survival supplies; and (d) at least one utility ring, carried by the elongate belt;

(B) a telescoping pole, carryable by one of the at least one utility ring, having a plurality of segments and associated locking means for transforming the telescoping pole between a shortened storage configuration and an extended usable configuration, and having an end piece carried by one of the plurality of segments;

(C) a thermal blanket, carryable by one of the at least one storage pouches;

(D) water-proof matches and a candle, carryable by one of the at least one storage pouches; and (E) water purification tablets, carryable by one of the at least one storage pouches.

* * * * *